US005282890A

United States Patent [19]

Protzer et al.

[11] Patent Number: 5,282,890

[45] Date of Patent: Feb. 1, 1994

[54] PROCESS FOR PRODUCING BROWN COVERING LAYERS ON COPPER

[75] Inventors: Helmut Protzer; Constantin Puscasu; Stefan Hoveling; Albert Scherger, all of Osnabrück, Fed. Rep. of Germany

[73] Assignee: KM-kabelmetal AG, Osnabrück, Fed. Rep. of Germany

[21] Appl. No.: 783,002

[22] Filed: Oct. 28, 1991

[30] Foreign Application Priority Data

Oct. 27, 1990 [DE] Fed. Rep. of Germany ..... 4034249

[51] Int. Cl.[5] ..... C23C 8/10

[52] U.S. Cl. ..... 148/276; 148/282

[58] Field of Search ..... 148/276, 282

[56] References Cited

U.S. PATENT DOCUMENTS 1,319,508 10/1919 Bengough ..... 148/276

4,954,185 7/1990 Kohm ..... 148/282

OTHER PUBLICATIONS

The Electrochemical Society, Dighton, pp. 375–380.

*Primary Examiner*—Sam Silverberg

*Attorney, Agent, or Firm*—Kenyon & Kenyon

[57] ABSTRACT

A method for producing a uniform and adherent brown covering layer (brown patina) on surfaces of semifinished products made of copper, particularly on rolled tapes or sheets used in building construction. The surface of the copper semifinished product is first roughened by means of a mechanical treatment. The copper semifinished product is then heat treated at a temperature lying within the temperature range of 150° to 650° C. for the duration of 0.1 to 30 minutes. The copper semifinished product can be advantageously subjected to a chemical postoxidation treatment immediately following the heat treatment.

6 Claims, No Drawings

PROCESS FOR PRODUCING BROWN COVERING LAYERS ON COPPER

BACKGROUND OF THE INVENTION

The invention relates generally to a process for producing brown covering layers on semifinished products made of copper, especially for rolled tapes and sheets used in roofing and facing.

Under normal atmospheric conditions, a very adhesive and resistant covering layer of copper oxide forms on the surface of bare metal copper. This oxide film, which at first is very thin, stabilizes the surface of the copper material with respect to the effects of the atmosphere. Ideally, the slow further development of the oxide layer, which results from the continued chemical reaction of the copper with moisture and atmospheric oxygen, gradually forms a uniform brown coloring (brown patina), so that the surface of the copper increasingly loses its metallic shine. With the passage of time, the brown covering layer becomes progressively darker and turns into an anthracite brown. This is the final state that usually sets in on perpendicular building surfaces, such as on an outerwall facing. In the case of sloped roof surfaces, the roof layer changes in color by reacting with the substances contained in the atmosphere such as sulphur dioxide, carbon dioxide and chlorides, to form alkaline copper compounds, until the patina-green that is typical of copper is attained.

Under certain atmospheric conditions, however, the formation of the brown covering layer can be considerably delayed and also accelerated in spots, resulting in a relatively long wait until the copper surface becomes uniformly discolored. Deviations from a uniform shade are especially noticeable in the initial weathering stage. First, irregular dark spots and/or stripes form over and over again on the copper surface. As the weathering action continues, however, these color variations noticeably decline due to atmospheric influences.

This invention is directed to the development of a process by which a uniform and very adherent brown covering layer (brown patina) can be produced, if desired on a large scale, on the surface of a semifinished product made of copper. This covering layer will not become damaged or peel off when it is further processed as may be required in building construction.

SUMMARY OF THE INVENTION

This objective is solved according to the process of the invention. A copper product is subjected to a first mechanical surface roughening treatment. It is then heat-treated between 150 and 650 degrees Celsius for between 0.1 and 30 minutes.

The process according of the invention helps to provide an unexpectedly simple way to successfully achieve a factory pre-weathering (brown patination) of the surface of a semifinished product made of copper, without having to wait for the dark-brown discoloration of the copper surface that is dependent on the long-term action of the atmosphere. This advantage particularly accommodates one's aesthetic feeling for a uniformly colored copper surface, for example for a roofing or facing composed of copper profile elements. A considerable advantage also lies in the fact that when repair work becomes necessary, suitable copper tapes or sheet copper provided with a brown patina can be made available to the plumber or other repairman. Thus, this pre-patinated material makes it possible to add, without any transition, to facings, which have already been exposed for a longer time to the atmospheric influences, without any differences becoming visible with respect to the shade of the brown covering layers on the individual facade elements.

Furthermore, the pre-patinated tapes or sheets of copper manufactured according to the process of the invention have covering layers which show exceptional adhesive or adherent strength and also remain deformation-resistant when subjected to bending or edging; i.e., they do not show any separation or cracking. Even finger marks, which often cannot be avoided when roofing and facings are installed, remain generally inconspicuous on the pre-patinated surface.

One can attain a still better adhesive strength for the covering layer and a particularly more uniform brown coloration of the pre-patinated copper surface by carrying out a chemical postoxidation immediately following the heat treatment, with an aqueous solution of at least one metallic salt from the group which includes potassium chlorate, potassium permanganate and sodium hypochlorite, alone or in a mixture with copper sulphate.

DETAILED DESCRIPTION

A number of chemical and electrolytic processes are known that give copper surfaces a brown color. However, without previous thermal oxidation, they often lead to an insufficient color saturation of the covering layers, particularly on a large scale. Furthermore, spots and streaks cannot normally be prevented from remaining on the surface, particularly when a processing solution is applied through a dipping treatment. The present invention avoids many of these problems.

In one embodiment, a cold-rolled and possibly degreased tape of SF copper, according to DIN 1787, having a thickness of 0.6 mm, and a breadth of 1,000 mm, was uniformly roughened with a grinding device. Endless sanding belts having a coarseness no. 180 and no. 320 were used for the surface treatment. The copper tape was then fed for heat treatment to a gas-heated continuous-heating furnace. For the surface oxidation of the copper tape which was heat-processed in a continuous cycle in the temperature range of 150° to 350° C., preferably at about 275° C. , a controlled gas atmosphere with an oxygen component of about 25 volume % was provided in the furnace. The heat treatment interval may vary between 0.1 and 30 minutes. After a short cooling interval, the pre-oxidized copper tape was then dipped, at a working temperature of about 80° C. (a temperature in the range of 20° C. to 90° C. could be used), in a bath containing an aqueous solution of a mixture of 50 g/l potassium chlorate (a concentration in the range of 20 g/l to 70 g/l could be used) and 100 g/l copper sulphate pentahydrate (a concentration in the range of 50 g/l to 150 g/l could be used). The duration of exposure to the processing solution amounted to about 2 to 3 minutes (this could vary between 1 and 10 minutes). The copper tape was subsequently rinsed with water and dried with hot air. After these treatment steps, the copper tape showed a very uniform covering layer with an intensive, dark-brown coloring. The brown patina proved to be very abrasion-proof. After additional bending and edging operations, the covering layer did not show any evidence of damage or separation.

What is claimed is:

1. A process for producing brown covering layers on semifinished products made of copper, comprising;

mechanically roughening the surface of a copper product; and heat treating the copper product in a controlled, oxidizing atmosphere at a temperature between 150° and 650° C. for a duration of between 0.1 and 30 minutes wherein immediately following the heat treatment, the copper semifinished product is additionally treated with an aqueous solution of a metallic salt from the group consisting of potassium chlorate, potassium permanganate and sodium hypochlorite, alone or in a mixture with copper sulphate.

2. The process for producing brown covering layers according to claim 1, wherein an aqueous solution of 20 to 70 g/l potassium chlorate and 50 to 150 g/l copper sulphate pentahydrate is applied to the surface of the copper semifinished product.

3. The process for producing brown covering layers according to claim 1, wherein the copper semifinished product is dipped in an aqueous solution at a temperature lying within the temperature range of 20° to 90° C. for a duration of about 1 to 10 minutes.

4. The process for producing brown covering layers according to claim 2, wherein the copper semifinished product is dipped in an aqueous solution at a temperature lying within the temperature range of 20° to 90° C. for a duration of about 1 to 10 minutes.

5. The process for providing brown covering layers according to claim 1, wherein the aqueous solution includes copper sulfate.

6. A process for producing brown covering layers on semifinished products made of copper, comprising:

mechanically roughening the surface of a copper product; and heat treating the copper product in a controlled, oxidizing atmosphere comprising about 25 volume % oxygen at a temperature between 150° and 350° C. for a duration of between 0.1 and 30 minutes.

* * * * *